US011946361B2

(12) United States Patent
Jones et al.

(10) Patent No.: US 11,946,361 B2
(45) Date of Patent: Apr. 2, 2024

(54) SETTING TWO OR MORE PROBES IN A BOREHOLE FOR DETERMINING A ONE STOP FORMATION PRESSURE GRADIENT IN THE FORMATION

(71) Applicant: Halliburton Energy Services, Inc., Houston, TX (US)

(72) Inventors: Christopher Michael Jones, Katy, TX (US); Bin Dai, Spring, TX (US); Anthony Herman van Zuilekom, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/824,280

(22) Filed: May 25, 2022

(65) Prior Publication Data

US 2022/0282612 A1 Sep. 8, 2022

Related U.S. Application Data

(63) Continuation of application No. 16/651,893, filed as application No. PCT/US2019/034521 on May 30, 2019, now Pat. No. 11,346,210.

(51) Int. Cl.
*E21B 47/06* (2012.01)
*E21B 47/04* (2012.01)
(Continued)

(52) U.S. Cl.
CPC ..... *E21B 47/06* (2013.01); *E21B 47/04* (2013.01); *E21B 47/13* (2020.05); *E21B 49/088* (2013.01); *E21B 2200/20* (2020.05)

(58) Field of Classification Search
CPC .... E21B 2200/20; E21B 47/04; E21B 47/053; E21B 47/06; E21B 47/07; E21B 47/13; E21B 49/087; E21B 49/088; E21B 49/10
See application file for complete search history.

(56) References Cited

U.S. PATENT DOCUMENTS 8,555,968 B2 10/2013 Zazovsky et al.
2004/0230378 A1 11/2004 Proett et al.
(Continued)

FOREIGN PATENT DOCUMENTS

WO 2020242470 A1 12/2020

OTHER PUBLICATIONS

PCT Application No. PCT/US2019/034521, International Preliminary Report on Patentability, dated Dec. 9, 2021, 6 pages.
(Continued)

*Primary Examiner* — Caroline N Butcher
(74) *Attorney, Agent, or Firm* — DeLizio, Peacock, Lewin & Guerra, LLP

(57) ABSTRACT

Quality factors associated with formation pressure measurements at various depths in the geologic formation are determined based on one or more well logs of formation properties in a geologic formation. A formation testing tool with two or more probes is positioned in a borehole of the geologic formation based on the quality factors. The two or more probes in the borehole perform respective formation pressure measurements, where each formation pressure measurement is performed at a different depth. The formation pressure measurements and the given distance between the two or more probes indicate a formation pressure gradient.

20 Claims, 10 Drawing Sheets

(51) Int. Cl.
*E21B 47/13* (2012.01)
*E21B 49/08* (2006.01)

(56) References Cited

U.S. PATENT DOCUMENTS

| | | | | |
|---|---|---|---|---|
| 2008/0149332 | A1* | 6/2008 | Gordon | E21B 49/088 166/264 |
| 2011/0174541 | A1* | 7/2011 | Strachan | E21B 44/00 702/9 |
| 2015/0039230 | A1* | 2/2015 | Proett | E21B 49/081 702/6 |
| 2015/0127262 | A1 | 5/2015 | Chen et al. | |
| 2018/0202264 | A1* | 7/2018 | Sarduy | G06N 20/00 |
| 2020/0378239 | A1 | 12/2020 | Jones et al. | |

OTHER PUBLICATIONS

PCT Application No. PCT/US2019/034521, International Written Opinion, dated Feb. 27, 2020, 5 pages.
PCT Application No. PCT/US2019/034521, International Search Report, dated Feb. 27, 2020, 4 pages.
U.S. Appl. No. 16/651,893, OfficeAction, dated Jul. 2, 2021, 14 pages.
Proett, et al., "Objectively Quantifying Wireline And LWD Pressure Test Quality", SPWLA 55th Annual Logging Symposium, May 18-22, 2014, 16 pages.

* cited by examiner

SETTING TWO OR MORE PROBES IN A BOREHOLE FOR DETERMINING A ONE STOP FORMATION PRESSURE GRADIENT IN THE FORMATION

TECHNICAL FIELD

The disclosure generally relates to the field of mining, and more particularly to setting two or more probes in a borehole for determining a one stop formation pressure gradient in the formation.

BACKGROUND ART

Formation pressure in a geologic formation is typically measured with a formation testing tool. A probe of the formation testing tool is pressed against a wall of a borehole in the geologic formation, and a small amount of fluid is drawn from the geologic formation through the probe and into the formation testing tool producing a pressure disturbance. If the draw is sufficient to cause pressure in the probe to decrease below the formation pressure, then generally when the draw stops the pressure builds back up. A stable build-up of the pressure indicates the formation pressure.

The formation testing tool is raised and/or lowered to various test points at various depths in the borehole to perform formation pressure measurements. A formation pressure gradient is calculated based on the formation pressure measurements at the various depths. The formation pressure gradient indicates how pressure in the geologic formation changes as a function of depth in the geologic formation.

Quality of the formation pressure measurement is a primary factor in determining accuracy of the formation pressure gradient. As a result, considerable time is spent moving the formation pressure tool to different positions in the borehole to find suitable test positions for performing the formation pressure measurement. Accuracy of the formation pressure gradient also depends on knowledge of the depth where each formation pressure measurement is performed. In this regard, determination of accurate formation pressure gradients in the borehole is operationally difficult.

BRIEF DESCRIPTION OF THE DRAWINGS

Embodiments of the disclosure may be better understood by referencing the accompanying drawings.

Figure 1:
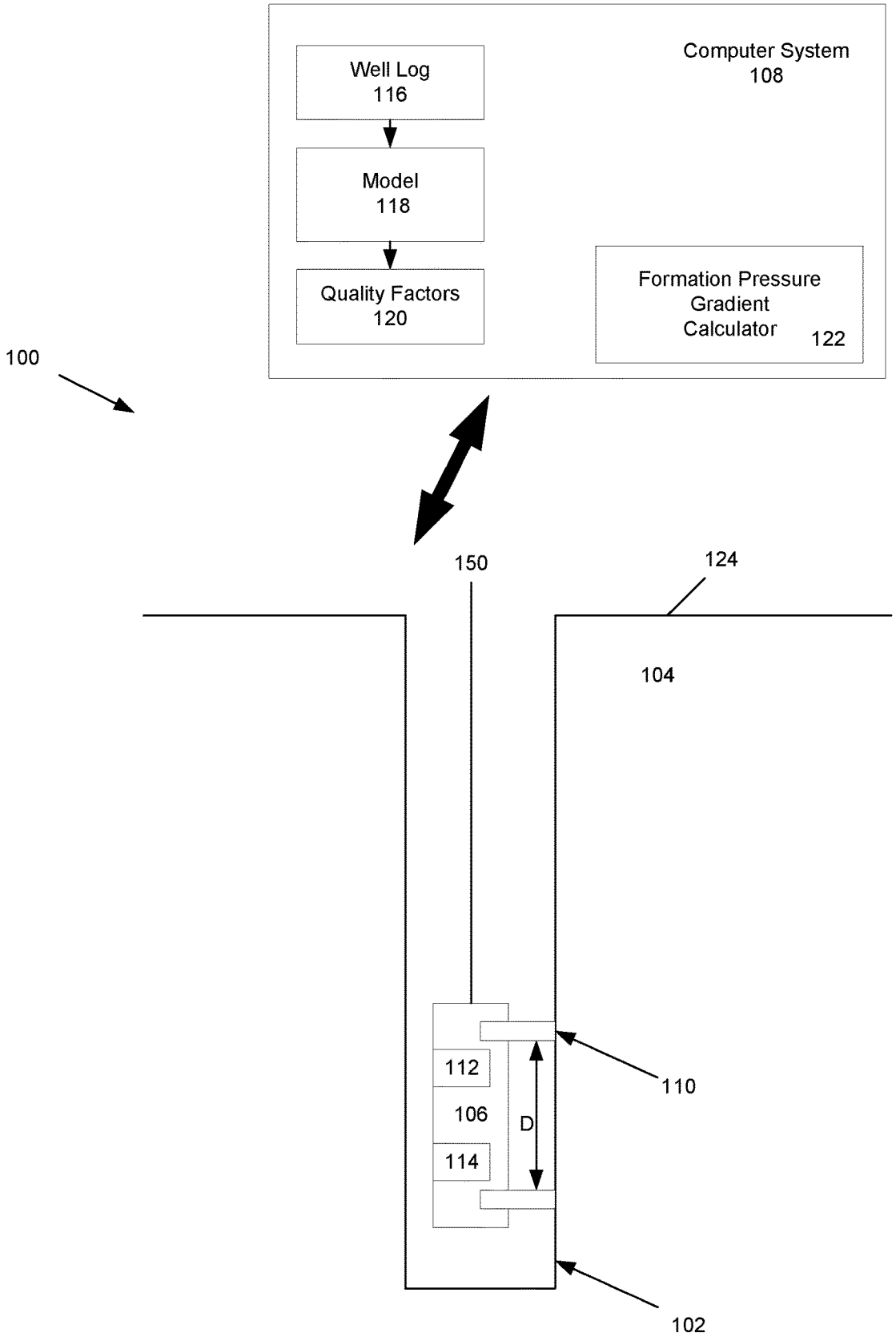
FIG. 1 illustrates a system for determining formation pressure and a formation pressure gradient in a borehole.

The drawings are for the purpose of illustrating example embodiments, but it is understood that the embodiments are not limited to the arrangements and instrumentality shown in the drawings.

DESCRIPTION OF EMBODIMENTS

The description that follows includes example systems, methods, techniques, and program flows that embody aspects of the disclosure. However, it is understood that this disclosure may be practiced without these specific details. For instance, this disclosure refers to determining a formation pressure gradient in a geologic formation in illustrative examples. Aspects of this disclosure can be applied to determining other types of gradients in other types of context. In other instances, well-known instruction instances, protocols, structures and techniques have not been shown in detail in order not to obfuscate the description.

Overview

Suitability of a position to perform a formation pressure measurement in a borehole is not known until the formation pressure measurement is started. If the position is found not to be suitable after starting the formation pressure measurement, a formation testing tool is moved to another position. The formation testing tool might need to be moved to several positions in the borehole before finding a suitable position to perform the formation pressure measurement.

Embodiments described herein are directed to determining the suitable position in the borehole to perform formation pressure measurements before actually performing formation pressure measurement. Well logs are detailed record of properties of the geologic formations penetrated by the borehole. A model correlates the well logs to pressure measurement quality factors (also referred to herein as quality factors, composite quality factors, and/or composite quality index) associated with formation pressure measurements at various positions in the borehole. The pressure measurement quality factor quantifies success of the formation pressure measurement at a given position in the borehole, i.e., how close the measured formation pressure would be to an actual formation pressure at the given position before the formation pressure measurement is actually performed. Success depends on a number of parameters such as individual quality metrics associated with drawdown stability, pressure stability, temperature stability, standard deviation of pressure, fluid mobility, depth of investigation, supercharging, repeatability of formation pressure measurement, among others. A composite quality index or composite quality factor may be calculated as, for instance, a weighted average, or weighted geometric average of the individual quality metrics to represent the quality factor associated with the formation pressure measurement. In one or more examples, the model outputs a pseudo log, which indicates quality factors associated with formation pressure measurements at various depths in the geologic formation, before the formation pressure measurement is actually performed. The quality factors are used to determine respective depths where two or more probes of the formation testing tool is to be positioned to obtain the formation pressure measurement associated with desired quality factors. After determining the respective depths, the formation testing tool is raised or lowered in the borehole to position the two or more probes at the respective depths. Then, the formation pressure measurements are performed.

Embodiments described herein are also directed to determining a pressure gradient in a formation without having to accurately determine a depth where a formation pressure measurement is performed. A distance between the two or more probes of the formation testing tool is known. The formation pressure measurements performed by the two or more probes and the distance between the two or more probes indicates the pressure gradient of the geologic formation. The formation testing tool need not be moved to determine a gradient. The formation pressure gradient indicates how pressure changes as a function of depth in the geologic formation. The formation pressure gradient is based on fluid density so the pressure gradient leads to a fluid density measurement. By knowing the density of fluids, gas, oil and water zones can be delineated and used to determine where to drill and to estimate oil reserve and value.

The description that follows includes example systems, apparatuses, and methods that embody aspects of the disclosure. However, it is understood that this disclosure may be practiced without these specific details. In other instances, well-known instruction instances, structures and techniques have not been shown in detail in order not to obfuscate the description.

Example Systems

FIG. 1 illustrates a system 100 for determining formation pressure and a formation pressure gradient in a borehole 102 drilled in a geologic formation 104. The system 100 includes a formation testing tool 106 that can be raised and lowered in the borehole 102 via a conveyance 150 such as a wireline including but not limited to a wireline slickline, coiled tubing, piping, downhole tractor, or a combination thereof, or logging while drilling (LWD) apparatus conveyed on a bottom hole assembly. The system 100 also includes a computer system 108 located at the surface 124 of the geologic formation 104 and/or downhole.

The formation testing tool 106 has probes 110, piston 112, and pressure gauge 114 to facilitate measuring the formation pressure in the geologic formation. The formation pressure is measured by positioning the probe 110 against a wall of the borehole 102. In one or more examples, a packer (not shown) may force the probe to press against the wall with a force ranging from, for example, 200 pounds per square inch (psi) to several thousand psi to form a seal with the wall and produce a pressure disturbance. The piston 112 then moves at a constant rate to draw a small amount of formation fluid, e.g., 20 ccs of fluid, from the geologic formation 104 through the pressure probe 110 and into the formation testing tool 106 over a period of time, e.g., 5 to 20 seconds. The draw causes pressure in the probe 110 to decrease below formation pressure as the piston 112 moves. When the piston 112 stops moving, the pressure builds back up. A stable build-up of the pressure indicates the formation pressure. The pressure gauge 114 then measures this formation pressure.

The formation testing tool 106 has two or more probes 110 positioned at a fixed distance D with respect to each other. The probes 110 may be generally separated by a distance D ranging from as little as 7 inches to as much as 15 feet, but other separations are also possible depending on the size of the formation testing tool 106. The two or more probes 110 allows the formation testing tool 106 to perform formation pressure measurements at two or more different positions in the borehole 102 without having to move the formation testing tool 106 in the borehole 102 for each formation pressure measurement.

The computer system 108 may store one or more well logs 116 and a model 118. The well log 116 is a detailed record of properties of the geologic formations penetrated by the borehole 102. The well log 116 may be based on visual inspection of samples brought to the surface 124 (geological logs) and/or physical measurements made by instruments lowered into the borehole 102 (geophysical logs) during wireline logging, logging while drilling (LWD), or other operations. The model 118 may correlate the one or more well logs 116 to pressure measurement quality factors 120 (also referred to herein as quality factors) associated with formation pressure measurements at various positions in the borehole 102. The pressure measurement quality factor 120 quantifies success of the formation pressure measurement at a given position in the borehole, i.e., how close the measured formation pressure would be to an actual formation pressure at the given position before the formation pressure measurement is actually performed. Success depends on a number of parameters such as individual quality metrics associated with drawdown stability, pressure stability, temperature stability, standard deviation of pressure, fluid mobility, depth of investigation, supercharging, repeatability of formation pressure measurement, among others. Drawdown stability relates to stability of the fluid flow during drawdown. Pressure stability and standard deviation of pressure relate to the stability of the pressure during the formation pressure measurement. Temperature stability relates to the stability of the temperature during the formation pressure measurement. Fluid mobility indicates ease to draw the formation fluid from the formation. The depth of investigation indicates a radius over which the formation fluid is drained in the formation. Supercharging is a condition when the borehole hydrostatic pressure is greater than the formation pressure. Repeatability of formation pressure measurement indicates whether the same formation pressure measurement is obtained based on multiple drawdowns and buildups of pressure at a position in the geologic formation. The quality factor quantifies one or more of these variables, among others, to indicate the quality of the formation pressure measurement.

The computer system 108 may use the quality factors 120 to determine respective depths where the two or more probes 110 of the formation testing tool 106 is to be positioned to obtain the formation pressure measurement associated with desired quality factors. After determining the respective depths, the formation testing tool 106 is raised or lowered in the borehole 102 to position the two or more probes 110 at the respective depths. The formation testing tool 106 is raised or lowered after the computer system 108 determines the respective depths to reduce chances of the formation testing tool sticking due to unnecessary movement within the borehole 102. Then, the formation pressure measurements are performed.

Because the formation testing tool 106 has two or more probes 110 and a distance between the two or more probes 110 is known, a formation pressure gradient calculator 122 determines a formation pressure gradient based on the formation pressure measurements performed by the two or more probes 110. The formation pressure gradient indicates how pressure changes as a function of depth in the geologic formation 104. In one example, the formation testing tool 106 may communicate the formation pressure measurements at two or more depths to the computer system 108 for storage, processing, and analysis. Based on the known distance between each probe 110 where each formation pressure measurement is performed, the computer system 108 may determine the formation pressure gradient. In another example, the formation testing tool 106 may perform the formation pressure measurements at two or more depths, determine the formation pressure gradient, and communicate the formation pressure gradient to the computer system 108. The formation pressure gradient is based on fluid density, so the pressure gradient leads to a fluid density measurement. By knowing the density of fluids, gas, oil and water zones can be delineated and used to determine where to drill and to estimate oil reserve and value.

Further knowledge of the formation pressure gradient can aid in sampling operations for which an aliquot of the formation fluid is recovered in a pressurized container also known as a bottle or chamber. Advantages can be made in determining where to sample along the borehole to target the desired fluid, when to sample in order to ensure contamination is sufficiently low for laboratory analysis, and how to sample in order to preserve quality of the aliquot as a representation of the formation fluid from which it was withdrawn. Advantages for contamination determination provide a reference of a property such as density for comparison to a fluid being withdrawn from the formation. As the aliquot density approaches the gradient density, contamination is determined as sufficiently low. One example of this contamination calculation is a contamination fraction:

$$\frac{|\text{density of aliquot} - \text{density of formation fluid}|}{|\text{density of mud filtrate} - \text{density of formation fluid}|}$$

which may be presented as a weight fraction or volume fraction with the knowledge of the fluid densities. This method is often used with a density sensor in the formation tester and sampler that can measure the density of the real time aliquot. One example of how to sample would depend on the identification of the formation fluid in the rock. If identified as a condensate range vs a black oil range, a lower pressure drawdown may be utilized in order prevent withdraw below a dew point that would fractionate the formation fluid and prevent a representative aliquot from being withdrawn. A second example is the determination of asphaltene precipitation if the density of a clean fluid being withdrawn is significantly lower than that indicated by the formation pressure gradient. These examples of where to sample, when to sample and how to sample are exemplary and represent various ways that a formation pressure gradient can be used to influence sampling operations.

Further, determination of formation pressure gradient can be used as a feedback to improve gradient determination. As one non-limiting example, if a formation pressure gradient determined in real time compared at one depth location is significantly different from the real time formation pressure gradient compared at a second location, then as a feedback to operations, further formation pressure gradient determination is required to resolve the ambiguity of the formation pressure gradient behavior as a function of depth. Causes in the formation pressure gradient ambiguity for instance may be compositional grading of the fluid within the reservoir, a compartmentalization break between the formation pressure gradient locations, or poor quality of formation pressure gradient data even with high quality pressure test analysis. These causes can now be delineated by a statistical comparison of high-resolution single stop formation pressure gradients that contain significantly reduced depth error.

Figure 2:
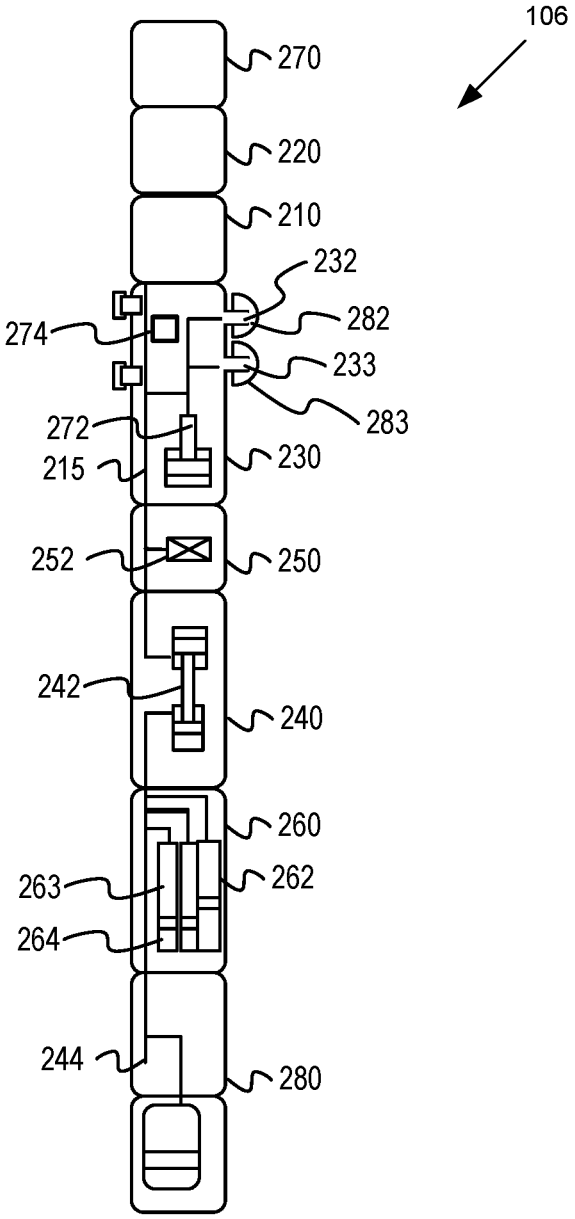
FIG. 2 illustrates an example formation testing tool.

FIG. 2 illustrates the formation testing tool 106 in more detail. The formation testing tool 106 may include various sections including an injection section 210; a power section 220 (e.g. a hydraulic power section capable of converting electrical into hydraulic power); a probe section 230 to take samples of the formation fluids; a flow control section 240 regulating the flow of various fluids in and out of the tool; a fluid test section 250 for performing different tests on a fluid sample; a sample collection section 260 that may contain various size chambers for storage of the collected fluid samples; a power telemetry section 270 that provides electrical and data communication between the sections; an uphole control system (not shown) and other sections 280. Various sections can be rearranged depending on the specific applications, and that the arrangement herein should not be considered as limiting.

The power telemetry section 270 conditions power for the sections. Each section can have its own process-control system and can function independently. While the power telemetry section 270 provides a common intra-tool power bus, the entire tool string can share a common communication bus that is compatible with other logging tools. Such an arrangement would enable the formation testing tool 106 to be combined with other logging systems, including, but not limited to, a Magnetic Resonance Image Logging (MRIL) or High-Resolution Array Induction (HRAI) logging systems. It should be realized that no combination of a tool run between a formation testing tool 106 and another tool section is necessary. As is typical other tool such as triple combo, resistivity and other electromagnetic tools, neutron density, gamma tools and other nuclear tools, nuclear magnetic resonance (NMR) tools, acoustic tools herein referred to conventional logging tools, are generally run separately. Generally, in the same way that conventional logging tools are stacked together to accomplish goals of logging, so can the formation testing tools such as pumps, sample sections, probe sections, and fluid analysis sections.

The injection section 210 and/or probe section 230 may inject fluids into the formation before collecting samples/measurements or inject fluids into the formation as samples are being collected. The flow control section 240 can include a piston 242, which can control the formation fluid flow from the formation drawn into probes 232, 233 of the probe section 230. While the formation testing tool 106 is shown to have two probes, alternative formation testing tools can have a different number of probes, such as three or more probes. Formation fluid which may also be drawn in via probes 232, 233 maybe be taken into a flow line 215 for testing within fluid testing section 250 and/or provided to sample collection section 260. A fluid control device, such as a control valve, can be connected to flow line 215 to control the flow of fluid from the flow line 215.

Probe section 230, specifically probes 232, 233, can have electrical and mechanical components that can facilitate testing, sampling, and extraction of fluids from the earth formation. The probes 232, 233 can be laterally extendable by one or more actuators inside the probe section 230 to extend the probes 232, 233 away from a body of the formation testing tool 106. Probe section 230 can retrieve and sample via a piston 272 formation fluids throughout the formation along the longitudinal axis of the borehole. The probes 232, 233 can be coupled to pads 282, 283 to provide a sealing contact with the inside surface of the borehole at a desired position. At least one of the probes 232, 233 can additionally include one or more quartz sensors or strain sensor such as a high-resolution temperature compensated strain gauge pressure transducer (not shown), either of which can be isolated with shut-in valves to monitor probe pressure. Probe section 230 may additionally include one or more flow rate sensors and/or pressure sensors 274 that can acquire measurements such as flow rate and/or inlet and outlet pump pressures. Similar to when a quartz sensor is used at 232,233, the pressure sensors 274 may be quartz pressure crystal pressure transducers/gauges. The quartz enables the device to obtain sensor measurements such as the drawdown pressure of fluid being withdrawn from the formation and the fluid temperature. Fluids from the sealed-off part of the earth formation may be collected through one or more slits, fluid flow channels, openings, outlets or recesses in the pad 282, 283.

In order to test the fluid drawn from the formation, the fluid testing section 250 can include a fluid testing device having fluid sensors, which can analyze the fluid flowing through flow line 215. For the purpose of this example, any suitable device or devices can be utilized to analyze the fluid of the formation using fluid sensors. Flow rate sensors can also be employed to determine the flow rate of the fluid being extracted to determine mobility/viscosity of hydrocarbon in the formation. In addition, either the fluid test section 250 or another section of the formation testing tool 106 can include additional sensors such as optical sensors, resistivity sensors, etc., wherein some or all of the sensors of the formation testing tool 106 can be employed in parallel.

Sample collection section 260 may contain chambers of various sizes for storage of the collected fluid sample. The sample collection section 260 can include at least one collection tube 262 and can additionally include a piston that divides collection tube 262 into an upper chamber 263 and a bottom chamber 264. A conduit can be coupled to the sample collection section 60 to provide fluid communication with the outside environment, such as the inner surface of the borehole. Sample collection section 260 may also contain a fluid flow control device, such as an electrically operated control valve, which is selectively opened and closed to direct the formation fluid from conduit into the sample collection section 260.

Figure 3:
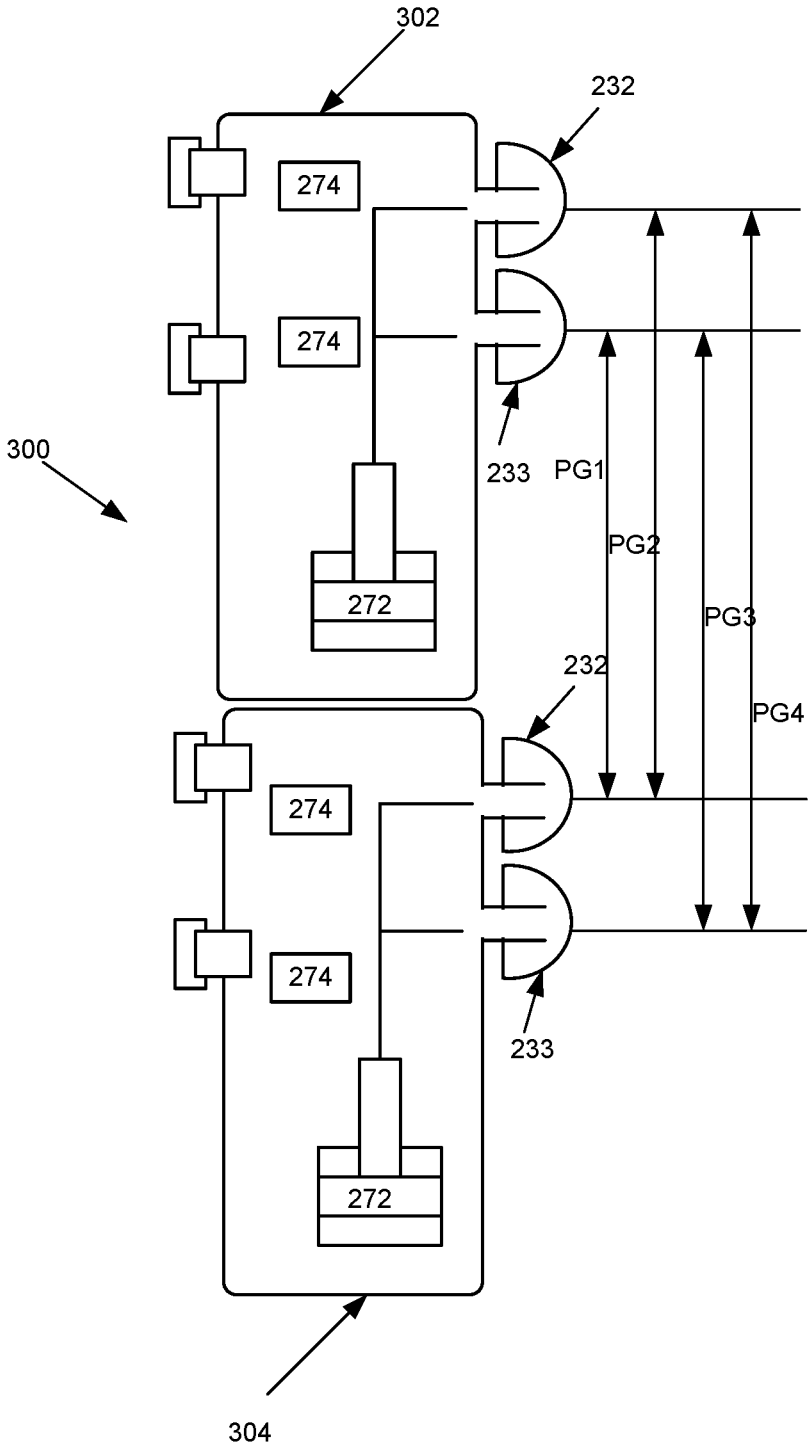
FIG. 3 illustrates an example stacking of example probe sections of the formation testing tool.

FIG. 3 illustrates an example stacking 300 of example probe sections 302, 304 (one of which corresponds to 230) for purposes of determining the pressure gradient in the geologic formation by the formation testing tool 106. Each probe section 302, 304 may have two probes 232, 233 for a total of 4 probes in the stack 300. Each probe may have a quartz for measuring pressure and each probe section 302, 304 may have a piston 272 for drawing the fluid from the geologic formation. The probes in a section may be separated by known distance such as 7.25 inches center to center within a section. The probe sections 302, 304 are also separated by a known distance. In one or more examples, the probes in the different sections may be separated by at least 15 feet. The example stack 300 of the example two probe sections 302, 304 may allow for determining different sets of formation pressure measurements separated by different distances. For example, the probe 233 of the probe section 302 and the probe 232 of the probe section 304 may perform formation pressure measurements and a pressure gradient PG1 determined based on a difference between these pressure measurements over a distance separating these probes. As another example, the probe 232 of the probe section 302 and the probe 232 of the probe section 304 may perform formation pressure measurements and a pressure gradient PG2 determined based on a difference between these pressure measurements over a distance separating these probes. In yet another example, the probe 233 of the probe section 302 and the probe 233 of the probe section 304 may perform formation pressure measurements and a pressure gradient PG3 determined based on a difference between these pressure measurements over a distance separating these probes. As another example, the probe 232 of the probe section 302 and the probe 233 of the probe section 304 may perform formation pressure measurements and a pressure gradient PG4 determined based on a difference between these pressure measurements over a distance separating these probes. Other variations are also possible.

Example Operations

Figure 4:
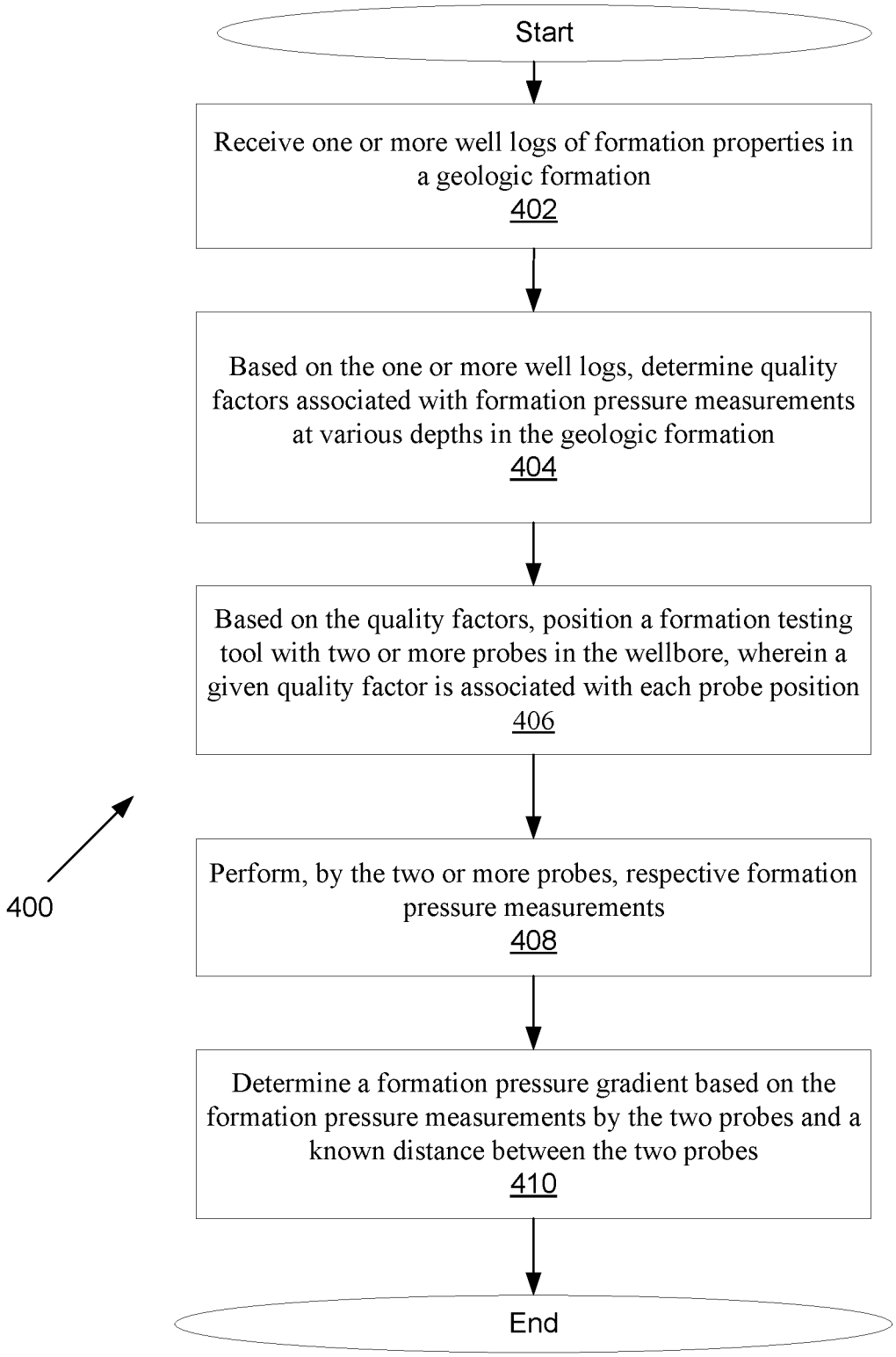
FIG. 4 is a flow chart of functions associated with determining a formation pressure gradient in a borehole of a geologic formation.

FIG. 4 is a flow chart 400 of functions associated with determining a formation pressure gradient in a borehole of a geologic formation. The formation testing tool is positioned at a position in the borehole where two or more formation pressure measurements are associated with respective quality factors. A formation pressure gradient is determined based on the two or more formation pressure measurements and a distance between the two or more probes. Knowledge of the quality factors associated with the formation pressure measurements before positioning the formation testing tool in the geologic formation reduces a need to move the formation testing tool to various positions in the borehole to find a suitable position to perform the formation pressure measurements. Also, the known distance between probes avoids having to accurately determine a depth each of each probe in the pressure gradient determination At 402, one or more well logs such as conventional logs of formation properties in a geologic formation is received. The well log may take various forms. The well logs may be nuclear logs which measures gamma ray, bulk density, standoff, density porosity, neutron porosity associated with the formation. As another example, the well logging may be electromagnetic logs including resistivity measurements across different spans of the borehole (e.g., 90, 60, 30, 20, and 10 inches) including true resistivity (Rt), and flushed zone resistivity (Rxo). The well logging may generate other types of logs including, but not limited to, acoustic, nuclear magnetic resonance (NMR), and/or imaging logs indicative of a formation's rock properties. Further, the well logs may be associated with formation information that often affects the quality of the well logs such as presence of mud cake on the wall of the borehole and drilled borehole quality, among other formation information.

At 404, based on the one or more well logs, a model determines quality factors associated with formation pressure measurements at various depths in the geologic formation before the formation pressure measurement is actually performed. The quality factor output by the model may as an example range from a minimum value to a maximum value such as 0 to 4. For example, a quality factor less than 3 may indicate a formation pressure measurement is likely to be poor, e.g., the formation measurement is not representative of a true formation pressure. As another example, a quality factor from 3 to 3.5 may indicate a formation pressure measurement is likely to be acceptable, e.g., the formation measurement is somewhat representative of a true formation pressure. In yet another example, a quality factor greater than 3.5 may indicate a formation pressure measurement is likely to be excellent, e.g., the formation measurement is representative of a true formation pressure and the formation pressure measurement is successful. The quality factor may take other forms as well. In one or more examples, the model may further correlate each quality factor to a class, where the class indicates whether or not a quality factor is a given value or falls within a range of values (e.g., a binary indication).

A model may correlate a quality factor to the output of conventional logs. The model may take various forms, an example of which is a supervised machine learning model that performs classification and/or pattern recognition techniques to correlate the one or more well logs to quality factors associated with formation pressure measurements performed at various depth in the geologic formation. The classification and/or pattern recognition techniques may include, but are not limited to, linear discriminant analysis (LDA), logistic regression, support vector machines (SVM), quadratic discriminate analysis (QDA), k nearest neighbor (KNN), artificial neural networks (ANN), and bag tree ensembles. A single model may be used to determine a quality factor. Alternatively, the quality factor output by one or more different models could be compared and/or combined to determine a final quality factor.

The model may be trained during a training process based on actual well logs and actual formation pressure measurements performed at different depths within a single well or for a plurality of wells. Each of the actual formation pressure measurements may also be assigned a quality factor based on analysis of attributes that impact success of the actual formation pressure measurement such as individual quality metrics associated with drawdown stability, pressure stability, temperature stability, standard deviation of pressure, fluid mobility, depth of investigation, supercharging, repeatability of the formation pressure measurement, among others. A composite quality index or composite quality factor may be calculated as, for instance, a weighted average, or weighted geometric average of the individual quality metrics to represent the quality factor associated with the formation pressure measurement. To illustrate, a training set may include 731 actual formation pressure measurements at various positions in a set of 20 wells, nuclear well logs, and electromagnetic well logs for the wells. The model is trained to output quality factors associated with formation pressure measurements performed at different depths based on the nuclear well logs and electromagnetic wells. The quality factors output by the model should sufficiently match the quality factors associated with the actual formation pressure measurements at the different depths. Sufficiency may be determined by both the risk that one is willing to take in quality index determination, with respect to accuracy required to minimize the risk. The model can also for instance cross validated where 20% of the training data (or some other percentage) is randomly held out iteratively to train the model. Based on this cross validation, each type of model can be characterized by statistics indicative of an ability of the model to predict the quality factor. The statistics may include a model accuracy value and positive prediction value as shown in Table 1 below.

TABLE 1

| Model | KNN | SVM | LDS | QDA | Logistic Regression | Bagged Tree Ensemble |
|---|---|---|---|---|---|---|
| Accuracy (%) | 77 | 77 | 73 | 74 | 73 | 75 |
| Positive Prediction Value (% Precision) | 80 | 76 | 72 | 78 | 72 | 79 |

The model accuracy value is a percent of correct assignments of the quality factors to the formation pressure measurements performed at various depths against the formation pressure measurements in the training set. The positive prediction value is a percent of correct assignments of the quality factors to the formation pressure measurements performed at various depths against the formation pressure measurements in the training set associated with a given class. For example, the positive prediction value may be calculated for a class of good formation pressure measurements in the training set, where two pressure measurement quality factors were used as the cutoff for a good formation pressure measurement versus a bad pressure measurement, namely 3 vs 2.5 respectively. The positive prediction value is a relevant statistic since it shows the likelihood that a formation pressure measurement at a given position is in fact a good formation pressure measurement at the position. Based on the statistics in Table 1, KNN performs best of the different types of techniques with an accuracy of 77% and positive prediction value of 80%.

The model may present the quality factors in the form of a pseudo log. The pseudo log indicates a quality factor for a formation pressure measurement performed at a particular depth in the borehole. For example, each depth is associated with a one or zero, where one indicates that the formation pressure measurement at the depth is associated with a particular quality factor and zero indicates that the formation pressure measurement is not associated with a particular quality factor, where the particular quality factor is the class. The pseudo log may take other forms as well.

Figure 5:
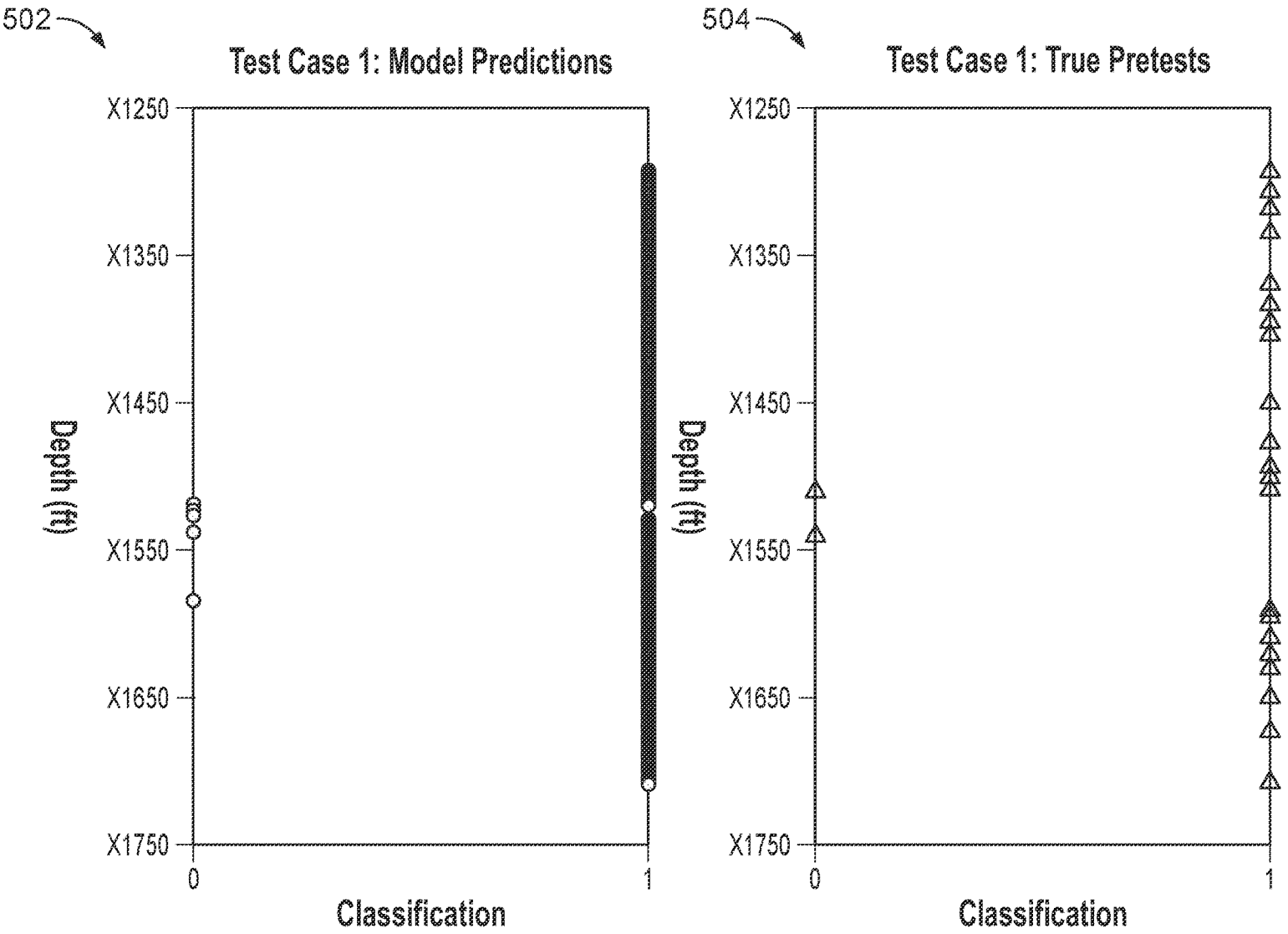
FIGS. 5, 6, 7A, and 7B illustrate various examples of model predictions compared to actual formation pressure measurements for test wells in a field of test wells.
Figure 6:
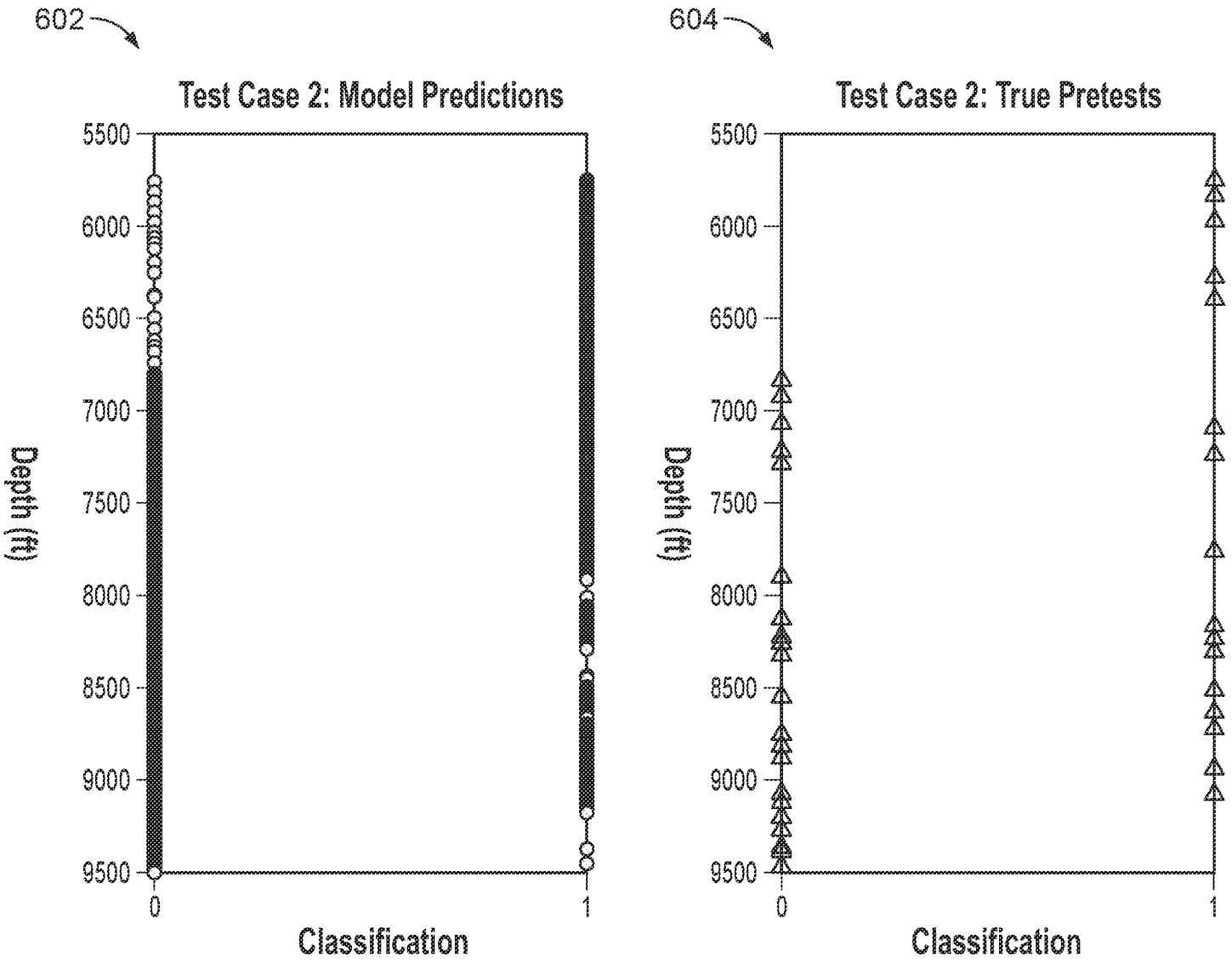

FIGS. 5-7 illustrate various examples of model predictions compared to actual pressure measurements for three test wells in a field of test wells. A first test well had a large number of high quality pressure measurements (92%) above a quality index of 3. A second test well nearly matched the average for the field with 51% high quality pressure measurements above a quality index of 3. A third test well had a few good pressure measurements with only 12% of the pressure measurements above a quality index of 3. This same well contained 33% of the pressure measurements above a value of 2.5.

FIG. 5 illustrates a pseudo log 502 from well 1 output by the model compared to actual formation pressure measurements 504. The classification applied by the model and to the actual formation pressure measurements is zero if the quality index is below three and one if the quality index is above three. Note that the model correctly identifies the difficult depths to test which occur around X1550 depth. The validation of this well is 96% accurate in correct predictions and 96% correct in positive prediction value.

FIG. 6 illustrates a pseudo log 602 from well 2 compared to actual formation pressure results 604. The classification applied by the model and to the actual formation pressure measurements is zero if the quality index is below three or one if the quality index is above three. Depths near the top of the test zone were easier to test, while depths near the bottom of the zone became more difficult to test. The validation of this well is 86% accurate in correct predictions and 86% correct in positive prediction value.

Figure 7B:
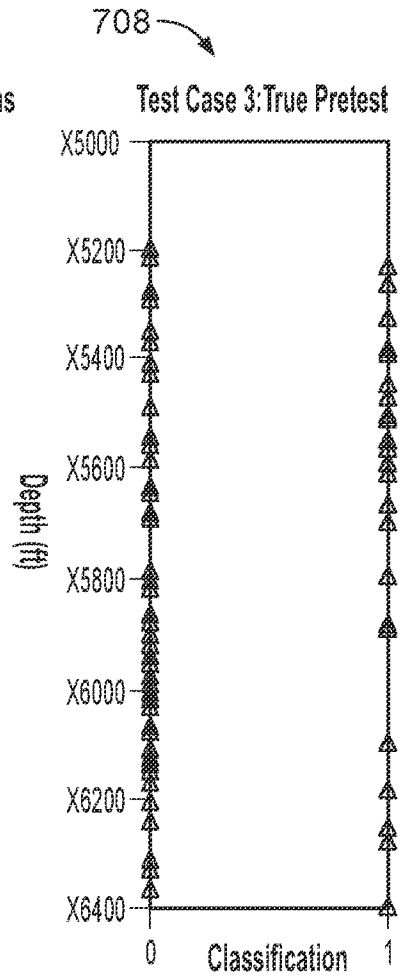
Figure 7B:
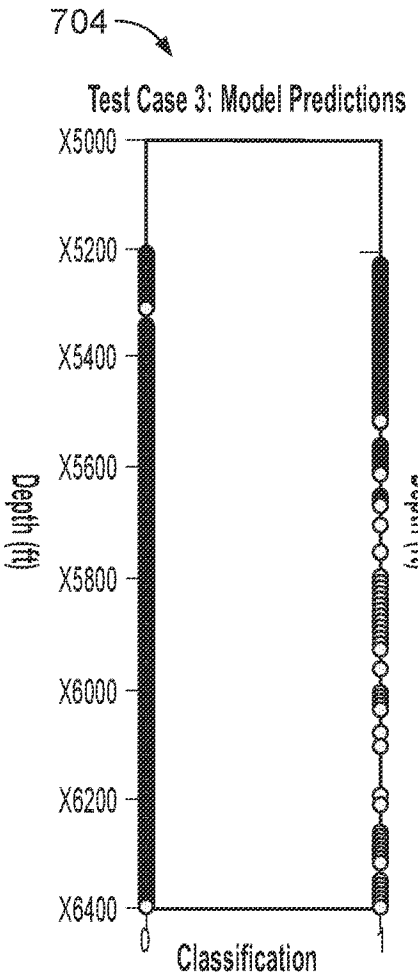
Figure 7A:
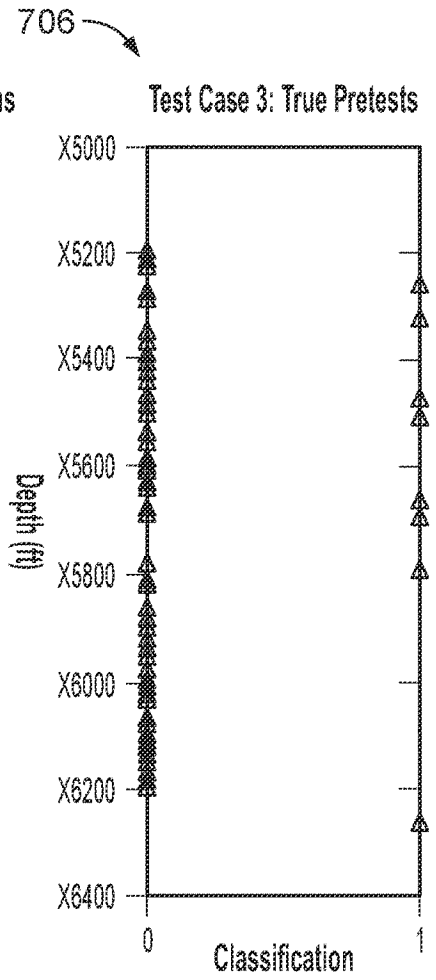
Figure 7A:
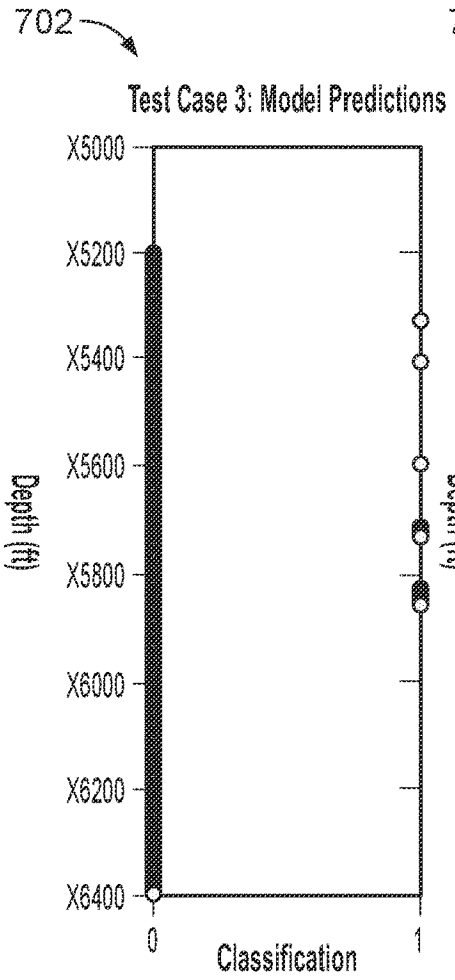

FIGS. 7A and 7B illustrate two pseudo logs 702, 704 from well 3 and actual formation pressure results 706, 708 for two different classifications of quality factors. In pseudo log 702, the accuracy of the model is 89% however; quality factors above 3 are too sparse for level to be useful. The model is used to generate a second pseudo log 704 with a cutoff quality factor of 2.5 above which was considered to be a good pressure measurement and below which was considered undesirable results. In this case, the model has an accuracy of 78% with a positive prediction value of 83%.

At 406, based on the quality factors, a formation testing tool with two or more probes is positioned in the borehole, wherein a given quality factor is associated with each probe position. Various methods are used to position the formation testing tool in the borehole at the given depths, including gamma ray tools. The quality factor needed for each formation pressure measurement may depend on a distance between the probes for purposes of the formation pressure gradient measurement. For example, a formation pressure measurement with a higher quality factor such as 3.7 may be needed if the distance between probes is 7 inches to preserve resolution of the formation pressure gradient within the 7 inches. As another example, a formation pressure measurement with a lower quality factor such as 2.5 may be needed if the distance between probes is 15 feet since resolution of the formation pressure gradient is already less due to the span in distance. In yet another example, the quality factor associated with the formation pressure measurement performed by each probe may be the same such as all high quality. As another example, the depth associated with each probe may be associated with different quality factors. For instance, the quality factor associated with the formation pressure measurement performed by one probe may be associated with a high quality factor while others may have lower quality factors. For instance, the quality factor associated with the formation pressure measurement performed by all probes except one may be associated with a high quality factor. In yet another example, if one section of the formation testing tool has two or more probes and another section of the formation testing tool has two or more probes, the quality factor associated with the formation pressure measurement performed by at least one probe in each of the sections may be associated with high quality factors. The quality factor associated with the formation pressure measurement may be chosen in other ways as well.

At 408, the two or more probes of the formation testing tool may perform respective formation pressure measurements. Because the formation pressure tool has two or more probes, the formation testing tool does not need to be moved in the borehole to perform the two formation pressure measurements in two different positions (i.e., "one-stop" formation pressure measurements).

The formation pressure measurements may be used to fine tune the pseudo log in one or more examples. The attributes which impact success of the formation pressure measurement may be collected during the formation pressure measurement by the formation testing tool. If a quality factor based on analysis of the attributes does not match the quality factor determined by the model, then the quality factor in the pseudo log may be changed to reflect the quality factor at the depth. The model may also be retrained in one or more examples so that the pseudo log output by the model continues to be representative. The formation pressure measurements may be used in other ways as well.

At 410, the formation pressure measurements associated with the two probes separated by a known distance between the two probes is used to generate a formation pressure gradient. The formation pressure gradient is determined based on the known distance between the two probes and the formation pressure measurements, e.g., a ratio of the difference of the formation pressure measurements and the known distance between the probes which is accurately known when the formation testing tool was constructed. Because the distance between the probes may be fixed as part of formation testing tool design, an accurate determination of depth of each of the probes is not needed to determine the formation pressure gradient. The pressure gradient may indicate a change in pressure over the distance which separates the two probes. The formation pressure gradient is based on fluid density, so the pressure gradient leads to a fluid density measurement. By knowing the density of fluids, gas, oil and water zone can be delineated and used to determine where to drill and to estimate oil reserve and value.

The well logs can be correlated to quality factors other than formation pressure measurements. For example, the well logs may be correlated to a pumpout quality at a position in the borehole based on a modeling process similar to that described above. Pumpout is a process of pumping a large amount of formation fluid out of formation (e.g., 50 gallons). The purpose of pumpout is to obtain clean formation fluid after pump of sufficient dirty fluid (contaminated fluid). The pumpout quality is indicative of how easy it is to pump the formation fluid out and quickly to obtain cleanest fluid at a given position in the borehole. In this regard, pumpout quality is indicative of fluid mobility. Based on the pumpout quality, the formation testing tool can be positioned in the borehole to perform the pumpout without having to raise and/or lower the formation testing tool to first find a suitable pumpout position in the borehole. The well logs can be correlated to yet other quality factors as well.

Example Apparatus

Figure 8:
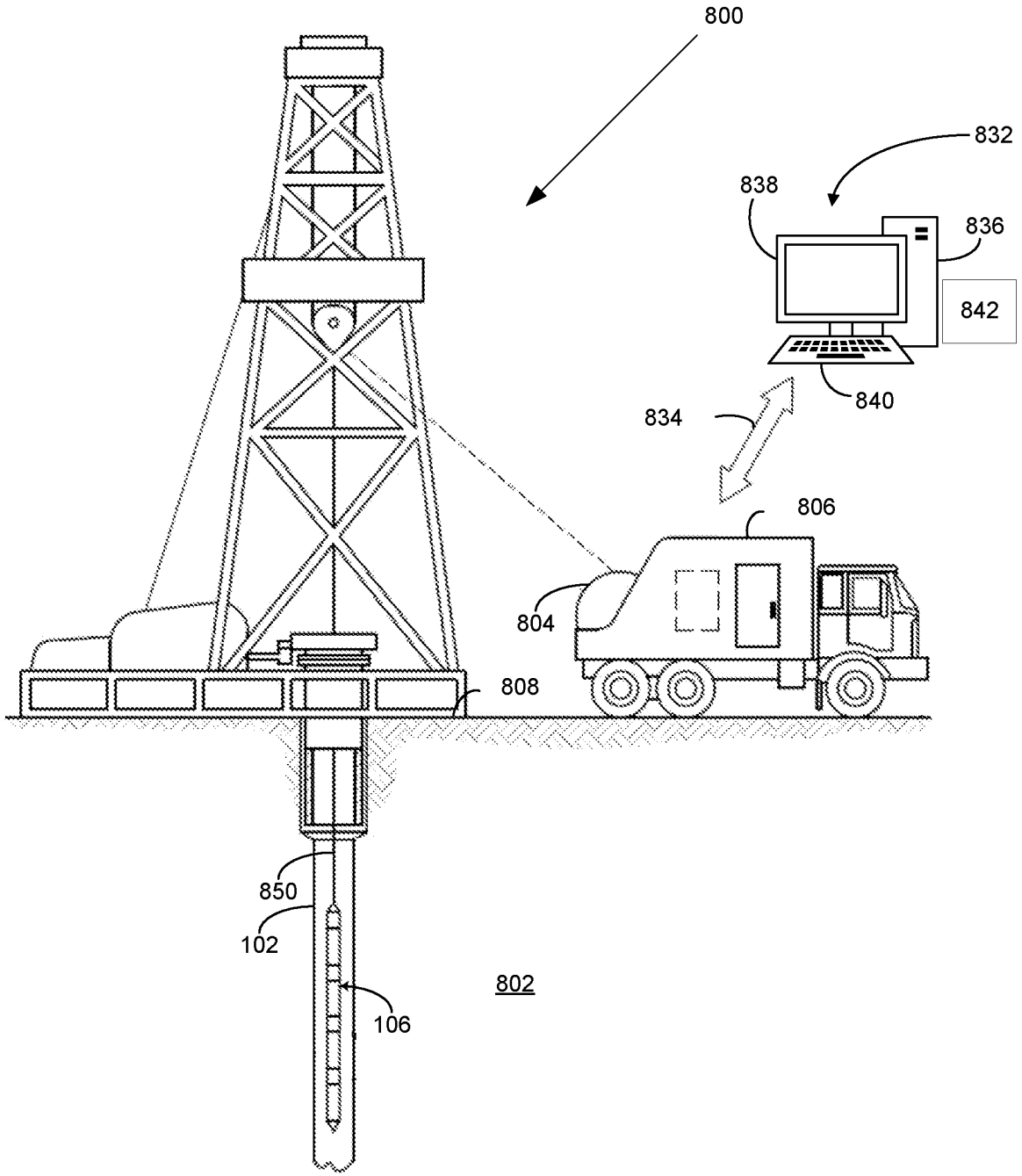
FIG. 8 is a schematic diagram of apparatus to perform some of the operations and functions described with reference to FIGS. 1-7.

FIG. 8 is a schematic diagram of an apparatus 800 that can be used to perform some of the operations and functions described with reference to FIGS. 1-7. A schematic diagram is shown of formation testing tool 106 on a wireline 850. As illustrated, a borehole 102 may extend through the geologic formation 802. It should be noted that while FIG. 8 generally depicts a land-based drilling system, those skilled in the art will readily recognize that the principles described herein are equally applicable to subsea drilling operations that employ floating or sea-based platforms and rigs, without departing from the scope of the disclosure.

As illustrated, hoist 804 may be used to run a formation testing tool 106 into borehole 102. Hoist 804 may be disposed on a recovery vehicle 806. Hoist 804 may be used, for example, to raise and lower wireline 850 in borehole 102. While hoist 804 is shown on recovery vehicle 806, it should be understood that wireline 850 may alternatively be disposed from a hoist 804 that is installed at the surface 808 instead of being located on recovery vehicle 806. Formation testing tool 106 may be suspended in borehole 102 on wireline 850. Other conveyance types may be used for conveying formation testing tool 106 into borehole 102, including coiled tubing, wired drill pipe, slickline, and downhole tractor, for example. Formation testing tool 106 may comprise a tool body, which may be elongated as shown on FIG. 8. Tool body may be any suitable material, including without limitation titanium, stainless steel, alloys, plastic, combinations thereof, and the like. Formation testing tool 106 may further include probes for measuring formation pressure in the geologic formation 802.

Computer system 832 may include a processing unit 836, a monitor 838, an input device 840 (e.g., keyboard, mouse, etc.), and/or machine readable media 842 (e.g., optical disks, magnetic disks) that can store code representative of the methods described herein for determining quality factors associated with formation pressure measurements at various depths in the borehole based on well logs, positioning the formation testing tool 106 in the geologic formation 802 to perform formation pressure measurements, and determining a pressure gradient of the geologic formation 802. To facilitate the determination of the pressure gradient, communication link 834 (which may be wired or wireless, for example) may transmit data indicative of formation pressure measurements between the formation testing tool 106 and the computer system 832 at surface 808. Communication link 834 may implement one or more of various known telemetry techniques such as mud-pulse, acoustic, electromagnetic, etc. In addition to, or in place of processing at the surface 808 to determine the pressure gradient, processing may occur downhole by the formation testing tool 106.

Figure 9:
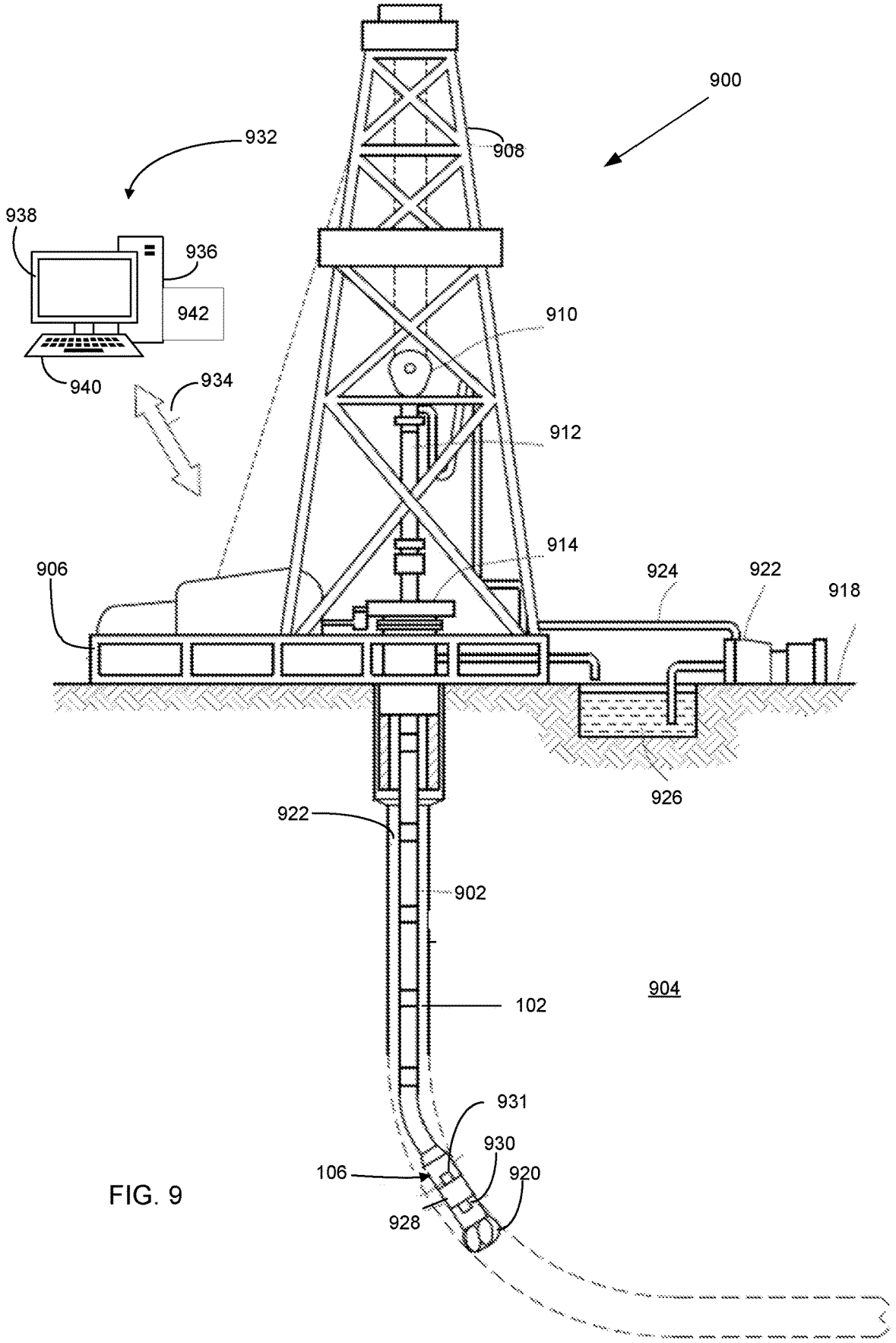
FIG. 9 is another schematic diagram of apparatus to perform some of the operations and functions described with reference to FIGS. 1-7.

FIG. 9 is another schematic diagram of an apparatus 900 that can be used to perform some of the operations and functions described with reference to FIGS. 1-7. The apparatus 900 includes a formation testing tool 106 disposed on a drill string 902 of a depicted well apparatus 900. As illustrated, a borehole 102 may extend through geologic formation 904. While borehole 102 is shown extending generally vertically into the geological formation 904, the principles described herein are also applicable to boreholes that extend at an angle through the geological formation 904, such as horizontal and slanted boreholes. For example, although FIG. 9 shows a vertical or low inclination angle well, high inclination angle or horizontal placement of the well and equipment is also possible. It should further be noted that while FIG. 9 generally depicts a land-based operation, those skilled in the art will readily recognize that the principles described herein are equally applicable to subsea operations that employ floating or sea-based platforms and rigs, without departing from the scope of the disclosure.

The apparatus further includes a drilling platform 906 that supports a derrick 908 having a traveling block 910 for raising and lowering drill string 902. Drill string 902 may include, but is not limited to, drill pipe and coiled tubing, as generally known to those skilled in the art. A kelly 912 may support drill string 902 as it may be lowered through a rotary table 914. A drill bit 920 may be attached to the distal end of drill string 902 and may be driven either by a downhole motor and/or via rotation of drill string 902 from the surface 918. Without limitation, drill bit 920 may include, roller cone bits, PDC bits, natural diamond bits, any hole openers, reamers, coring bits, and the like. As drill bit 920 rotates, it may create and extend borehole 102 that penetrates various subterranean formations such as 904. A pump 923 may circulate drilling fluid through a feed pipe 924 to kelly 912, downhole through interior of drill string 902, through orifices in drill bit 920, back to surface 918 via annulus 922 surrounding drill string 902, and into a retention pit 926.

Drill bit 920 may be just one piece of a downhole assembly that may include the formation testing tool 106. Formation testing tool 106 may be made of any suitable material, including without limitation titanium, stainless steel, alloys, plastic, combinations thereof, and the like. Formation testing tool 106 may further include two or more probes 930, 931 for performing formation pressure measurements. Any suitable technique may be used for transmitting signals, e.g., formation pressure measurements, to a computer system 932 residing on the surface 918. As illustrated, a communication link 934 (which may be wired or wireless, for example) may be provided that may transmit data from formation testing tool 106 to the computer system 932 at the surface 918. Computer system 932 may include a processing unit 936, a monitor 938, an input device 940 (e.g., keyboard, mouse, etc.), and/or machine readable media 942 (e.g., optical disks, magnetic disks) that can store code representative of the methods described herein. Computer system 932 may act as a data acquisition system and possibly a data processing system that analyzes formation pressure measurements from formation testing tool 106. For example, computer system 932 may process the formation pressure measurements from formation testing tool 106 for determining a formation pressure gradient as described herein. This processing may occur at the surface 918 in real-time. Alternatively, the processing may occur at surface 918 or another location after withdrawal of formation testing tool 106 from borehole 102. Still alternatively, the processing may be performed downhole in the geologic formation 904 by the formation testing tool 106.

Figure 10:
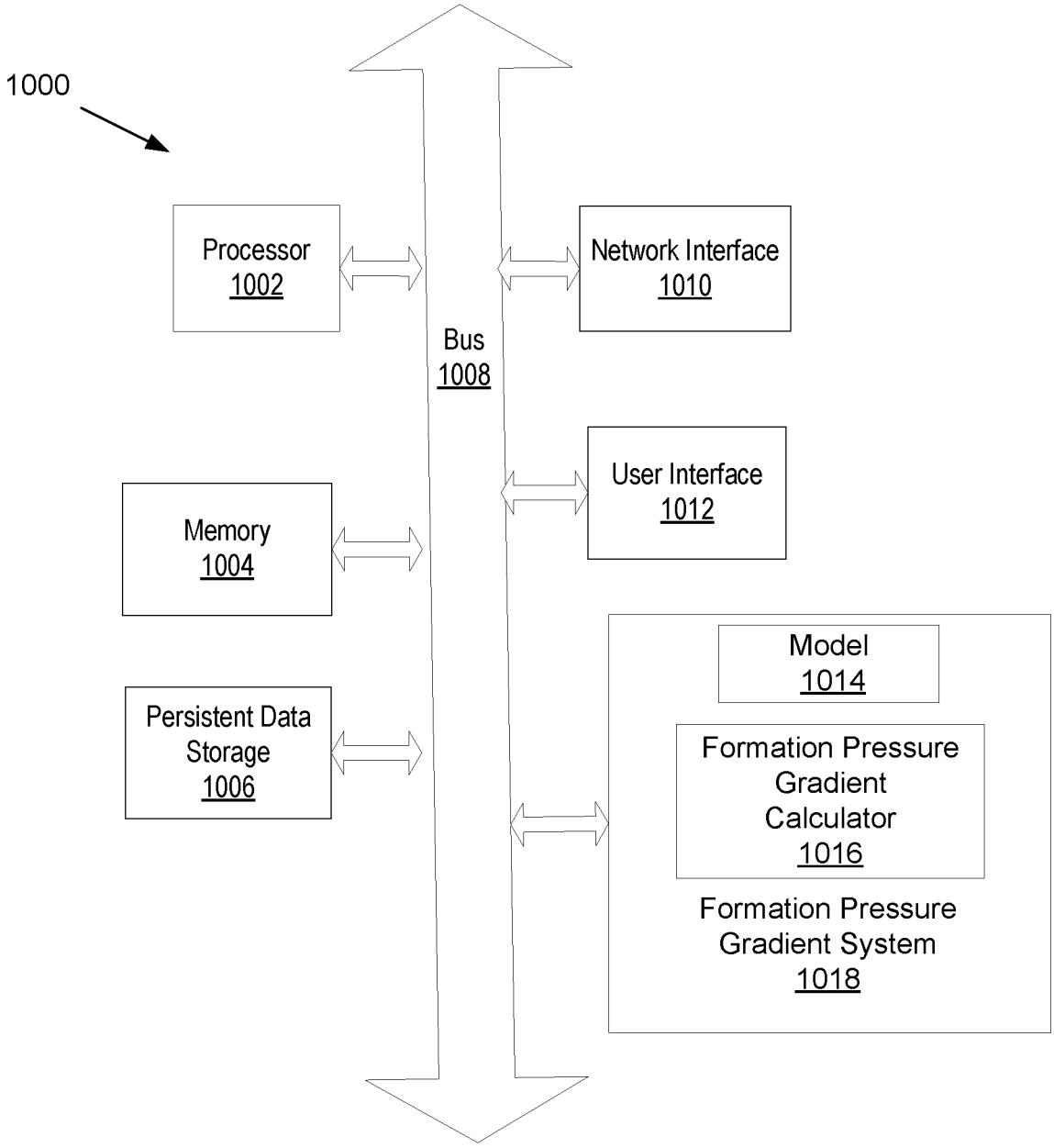
FIG. 10 is a block diagram of a computer system associated with determining a formation pressure gradient in a borehole of a geologic formation.

FIG. 10 is a block diagram of the apparatus 1000 of the computer system 832, 932 and/or formation testing tool 106 for determining pressure gradient in a geologic formation as described above. The apparatus 1000 may be located on the surface, downhole, or partially on the surface and partially downhole.

The apparatus 1000 includes a processor 1002 (possibly including multiple processors, multiple cores, multiple nodes, and/or implementing multi-threading, etc.). The apparatus 1000 includes memory 1004. The memory 1004 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more other possible realizations of non-transitory machine-readable media/medium.

The apparatus 1000 may also include a persistent data storage 1006. The persistent data storage 1006 can be a hard disk drive, such as a magnetic storage device which stores one or more of operating conditions, application input, supervisory input, model inputs, and a goal set. In one or more examples, the persistent data storage 1006 may store well logs. The apparatus also includes a bus 1008 (e.g., PCI, ISA, PCI-Express) and a network interface 1010 in communication with a formation testing tool. A formation pressure gradient system 1018 may have a model 1014 for determining quality factors based on the well logs stored in the persistent data storage 1006, and a formation gradient calculator 1016 for determining pressure gradient in a geologic formation as described above.

The apparatus 1000 may further comprise a user interface 1012. The user interface 1012 may include a display such as a computer screen or other visual device to show the formation pressure measurements, quality factors, and/or pressure gradients to engineering personnel. The user interface 1012 may also include an input device such as a mouse, keyboard.

The apparatus 1000 may implement any one of the previously described functionalities partially (or entirely) in hardware and/or software (e.g., computer code, program instructions, program code) stored on a non-transitory machine readable medium/media. In some instances, the software is executed by the processor 1002. Further, realizations can include fewer or additional components not illustrated in FIG. 10 (e.g., video cards, audio cards, additional network interfaces, peripheral devices, etc.). The processor 1002 and the memory 1004 are coupled to the bus 1008. Although illustrated as being coupled to the bus 1008, the memory 1004 can be coupled to the processor 1002.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. For example, the operations depicted in blocks 402-410 can be performed in parallel or concurrently. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine readable medium may be a machine readable signal medium or a machine readable storage medium. A machine readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine readable storage medium may be any tangible medium that can contain, or store a program for use by or in connection with an instruction execution system, apparatus, or device. A machine readable storage medium is not a machine readable signal medium.

A machine readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine readable signal medium may be any machine readable medium that is not a machine readable storage medium and that can communicate, propagate, or transport a program for use by or in connection with an instruction execution system, apparatus, or device.

Program code embodied on a machine readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine readable medium that can direct a machine to function in a particular manner, such that the instructions stored in the machine readable medium produce an article of manufacture including instructions which implement the function/act specified in the flowchart and/or block diagram block or blocks.

While the aspects of the disclosure are described with reference to various implementations and exploitations, it will be understood that these aspects are illustrative and that the scope of the claims is not limited to them. In general, techniques for determining a pressure gradient in a geologic formation as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed. As used herein, the term "or" is inclusive unless otherwise explicitly noted. Thus, the phrase "at least one of A, B, or C" is satisfied by any element from the set {A, B, C} or any combination thereof, including multiples of any element.

Example Embodiments

Example embodiments include the following

Embodiment 1 is a method, the method comprising receiving one or more well logs of formation properties in a geologic formation; determining quality factors associated with formation pressure measurements performed at different depths in the geologic formation based on the one or more well logs; positioning a formation testing tool with two or more probes in a borehole of the geologic formation based on the quality factors, wherein a given quality factor is associated with each probe position, and wherein the two or more probes are separated by a given distance along a body of the formation testing tool; performing, by the two or more probes, respective formation pressure measurements in the borehole, wherein each formation pressure measurement is performed at a respective depth; and determining a formation pressure gradient based on the formation pressure measurements and the given distance which separates the two or more probes. The one or more well logs as described in Embodiment 1 includes a nuclear well log and an electromagnetic well log. Any of the preceding embodiments further comprises drilling in the geologic formation based on the formation pressure gradient. Determining the quality factors as described in in any of the preceding embodiments comprises inputting the one or more well logs into a machine learning model which outputs the quality factors associated with formation pressure measurement. The quality factors associated with formation pressure measurements as described in any of the preceding embodiments is a pseudo log of quality factors as a function of depth. The machine learning model as described in any of the preceding embodiments is a k nearest neighbor model. The given quality factor associated with each probe position as described in any of the preceding embodiments is different. The quality factors as described in any of the preceding embodiments indicate success of respective formation pressure measurements. Performing by the two or more probes, respective formation pressure measurements in the borehole as described in any of the preceding embodiments comprises performing two or more formation pressure measurements at the different depths while the formation testing tool is stationary.

Embodiment 2 is a system, the system comprising a formation testing tool with two or more probes separated by a given distance along a body of the formation testing tool; a processor; a non-transitory machine readable media having program code executable by the processor to cause the processor to: receive one or more well logs of formation properties in a geologic formation; determine quality factors associated with formation pressure measurements performed at different depths in the geologic formation based on the one or more well logs; position the formation testing tool in a borehole of the geologic formation based on the quality factors, wherein a given quality factor is associated with each probe position; perform, by the two or more probes, respective formation pressure measurements in the borehole, wherein each formation pressure measurement is performed at a respective depth; and determine a formation pressure gradient based on the formation pressure measurements and the given distance which separates the two or more probes. The one or more well logs as described in any of the preceding embodiments of Embodiment 2 includes a nuclear well log and an electromagnetic well log. Any of the preceding embodiments of Embodiment 2 further comprises program code to drill in the geologic formation based on the formation pressure gradient. The program code to determine the quality factors as described in any of the preceding embodiments of Embodiment 2 comprises program code to input the one or more well logs into a machine learning model which outputs the quality factors associated with formation pressure measurements. The quality factors associated with formation pressure measurements as described in any of the preceding embodiments of Embodiment 2 is a pseudo log of quality factors as a function of depth. The machine learning model as described in any of the preceding embodiments of Embodiment 2 is a k nearest neighbor model. The given quality factor associated with each probe position as described in any of the preceding embodiments of Embodiment 2 is different. The program code to perform, by the two or more probes, respective formation pressure measurements in the borehole as described in any of the preceding embodiments of Embodiment 2 comprises program code to perform two or more formation pressure measurements at the different depths while the formation testing tool is stationary.

Embodiment 3 is one or more non-transitory machine-readable media, the one or more non-transitory machine readable media comprises program code executable by a processor, the program code to: receive one or more well logs of formation properties in a geologic formation; determine quality factors associated with formation pressure measurements performed at different depths in the geologic formation based on the one or more well logs; position a formation testing tool with two or more probes in a borehole of the geologic formation based on the quality factors, wherein a given quality factor is associated with each probe position; and wherein the two or more probes are separated by a given distance along a body of the formation testing tool; perform, by the two or more probes, respective formation pressure measurements in the borehole, wherein each formation pressure measurement is performed at a respective depth; and determine a formation pressure gradient based on the formation pressure measurements and the given distance which separates the two or more probes. The quality factors associated with formation pressure measurements as described in Embodiment 3 is a pseudo log of quality factors as a function of depth. The program code to perform, by the two or more probes, respective formation pressure measurements in the borehole as described in any of the preceding embodiments of Embodiment 3 comprises program code to perform two or more formation pressure measurements at the different depths while the formation testing tool is stationary.

What is claimed is:

1. A method comprising:

receiving one or more well logs of formation properties in a geologic formation;

determining quality factors associated with formation pressure measurements performed at different depths in the geologic formation based on the one or more well logs, wherein the quality factors indicate likelihood of success of obtaining respective formation pressure measurements at the different depths in the geological formation;

positioning a formation testing tool with two or more probes in a borehole of the geologic formation based on the quality factors, wherein a given quality factor is associated with each probe position, and wherein the two or more probes are separated by a given distance along a body of the formation testing tool;

obtaining, by the two or more probes, respective formation pressure measurements in the borehole, wherein each formation pressure measurement is performed at a respective depth; and determining a formation pressure gradient based on the formation pressure measurements and the given distance which separates the two or more probes.

2. The method of claim 1, wherein the one or more well logs includes a nuclear well log and an electromagnetic well log.

3. The method of claim 1, further comprising drilling in the geologic formation based on the formation pressure gradient.

4. The method of claim 1, wherein determining the quality factors comprises inputting the one or more well logs into a machine learning model which outputs the quality factors associated with formation pressure measurements.

5. The method of claim 4, wherein the quality factors associated with formation pressure measurements is a pseudo log of quality factors as a function of depth.

6. The method of claim 4, wherein the machine learning model is a k nearest neighbor model.

7. The method of claim 1, wherein the given quality factor associated with each probe position is different.

8. The method of claim 1, wherein the success of the respective formation pressure measurements is based on parameters including drawdown stability, pressure stability, and temperature stability.

9. The method of claim 1, wherein performing by the two or more probes, respective formation pressure measurements in the borehole comprises performing two or more formation pressure measurements at the different depths while the formation testing tool is stationary.

10. A system comprising:

a formation testing tool with two or more probes separated by a given distance along a body of the formation testing tool;

a processor;

a non-transitory machine readable media having program code executable by the processor to cause the processor to:

receive one or more well logs of formation properties in a geologic formation;

determine quality factors associated with formation pressure measurements performed at different depths in the geologic formation based on the one or more well logs, wherein the quality factors indicate likelihood of success of obtaining respective formation pressure measurements at the different depths in the geological formation;

position the formation testing tool in a borehole of the geologic formation based on the quality factors, wherein a given quality factor is associated with each probe position;

obtain, by the two or more probes, respective formation pressure measurements in the borehole, wherein each formation pressure measurement is performed at a respective depth; and determine a formation pressure gradient based on the formation pressure measurements and the given distance which separates the two or more probes.

11. The system of claim 10, wherein the one or more well logs includes a nuclear well log and an electromagnetic well log.

12. The system of claim 10, further comprising program code to drill in the geologic formation based on the formation pressure gradient.

13. The system of claim 10, wherein the program code to determine the quality factors comprises program code to input the one or more well logs into a machine learning model which outputs the quality factors associated with formation pressure measurements.

14. The system of claim 13, wherein the quality factors associated with formation pressure measurements is a pseudo log of quality factors as a function of depth.

15. The system of claim 13, wherein the machine learning model is a k nearest neighbor model.

16. The system of claim 10, wherein the given quality factor associated with each probe position is different.

17. The system of claim 10, wherein the program code to perform, by the two or more probes, respective formation pressure measurements in the borehole comprises program code to perform two or more formation pressure measurements at the different depths while the formation testing tool is stationary.

18. A non-transitory, computer-readable medium having instructions stored thereon that are executable by a computing device to perform operations comprising:

receiving one or more well logs of formation properties in a geologic formation;

determine quality factors associated with formation pressure measurements performed at different depths in the geologic formation based on the one or more well logs, wherein the quality factors indicate likelihood of success of obtaining respective formation pressure measurements at the different depths in the geological formation;

positioning a formation testing tool with two or more probes in a borehole of the geologic formation based on the quality factors, wherein a given quality factor is associated with each probe position; and wherein the two or more probes are separated by a given distance along a body of the formation testing tool;

obtaining, by the two or more probes, respective formation pressure measurements in the borehole, wherein each formation pressure measurement is performed at a respective depth; and determining a formation pressure gradient based on the formation pressure measurements and the given distance which separates the two or more probes.

19. The non-transitory, computer-readable medium of claim 18, wherein the quality factors associated with formation pressure measurements is a pseudo log of quality factors as a function of depth.

20. The non-transitory, computer-readable medium of claim 18, wherein performing, by the two or more probes, respective formation pressure measurements in the borehole comprises performing two or more formation pressure measurements at the different depths while the formation testing tool is stationary.

* * * * *